US007391393B2

(12) United States Patent
Yang et al.

(10) Patent No.: US 7,391,393 B2
(45) Date of Patent: Jun. 24, 2008

(54) LOW POWER AND HIGH DENSITY SOURCE DRIVER AND CURRENT DRIVEN ACTIVE MATRIX ORGANIC ELECTROLUMINESCENT DEVICE HAVING THE SAME

(75) Inventors: Yil-Suk Yang, Daejon (KR); Byung-Doo Kim, Daejon (KR); Jong-Dae Kim, Daejon (KR); Tae-Moon Roh, Daejon (KR); Dae-Woo Lee, Daejon (KR); Byoung-Gon Yu, Daejon (KR); Il-Yong Park, Daejon (KR); Sung-ku Kwon, Daejon (KR)

(73) Assignee: Electronics and Telecommunications Research Institute (KR)

( * ) Notice: Subject to any disclaimer, the term of this patent is extended or adjusted under 35 U.S.C. 154(b) by 536 days.

(21) Appl. No.: 10/739,735

(22) Filed: Dec. 17, 2003

(65) Prior Publication Data

US 2005/0007315 A1 Jan. 13, 2005

(30) Foreign Application Priority Data

Jul. 11, 2003 (KR) ..... 10-2003-0047184

(51) Int. Cl.
*G09G 3/30* (2006.01)

(52) U.S. Cl. ..... 345/76; 345/211

(58) Field of Classification Search ..... 345/76, 345/77, 82, 83, 205, 211, 204; 315/169.1–169.3
See application file for complete search history.

(56) References Cited

U.S. PATENT DOCUMENTS 4,962,374 A * 10/1990 Fujioka et al. ..... 345/79
5,517,207 A * 5/1996 Kawada et al. ..... 345/78
6,369,783 B1 * 4/2002 Kwon et al. ..... 345/74.1
6,693,385 B2 * 2/2004 Koyama ..... 315/169.1
6,900,783 B2 * 5/2005 Jin ..... 345/60

(Continued)

FOREIGN PATENT DOCUMENTS

KR 2002-20419 3/2002

(Continued)

*Primary Examiner*—Regina Liang
(74) *Attorney, Agent, or Firm*—Blakely, Sokoloff, Taylor & Zafman

(57) ABSTRACT

Disclosed is a low power and high density source driver and a current driven active matrix organic electroluminescent device having the same, in which all elements operate at a normal voltage and all circuits of the source driver are shielded from a high voltage of a panel. The source driver includes: a shift register for generating an enable signal for storing data; a data latch circuit for storing digital data inputted from an exterior; a line latch circuit for sequentially storing the data in response to the enable signal and outputting the stored data in parallel at one time in response to a load signal; a current type digital-to-analog converter for converting the digital data outputted from the line latch circuit into an analog signal, the analog signal being outputted in a form of a current signal; and a high voltage shield circuit for transferring the output of the current digital-to-analog converter to source lines of an external panel and for shielding internal circuits from a high voltage of the panel. The shift register, the data latch circuit, the line latch circuit, the current type digital-to-analog converter and the high voltage shield circuit are driven at a normal voltage.

8 Claims, 6 Drawing Sheets

U.S. PATENT DOCUMENTS

| | | | | |
|---|---|---|---|---|
| 2003/0107535 | A1* | 6/2003 | Numao | 345/76 |
| 2003/0137503 | A1* | 7/2003 | Kimura et al. | 345/212 |
| 2003/0234754 | A1* | 12/2003 | Abe et al. | 345/76 |
| 2004/0239655 | A1* | 12/2004 | Tani et al. | 345/204 |
| 2005/0180083 | A1* | 8/2005 | Takahara et al. | 361/152 |

FOREIGN PATENT DOCUMENTS

| | | |
|---|---|---|
| KR | 2002-58101 | 7/2002 |
| KR | 2002-76146 | 10/2002 |

* cited by examiner

LOW POWER AND HIGH DENSITY SOURCE DRIVER AND CURRENT DRIVEN ACTIVE MATRIX ORGANIC ELECTROLUMINESCENT DEVICE HAVING THE SAME

FIELD OF THE INVENTION

The present invention relates to a source driver for a current driven active matrix organic electroluminescent device; and, more particularly, to a low power and high density source driver and a current driven active matrix organic electroluminescent device having the same, in which all elements operate at a normal voltage and all internal circuits of the source driver are shielded from a high voltage of a panel.

DESCRIPTION OF THE PRIOR ART

Generally, a source driver for a flat panel display is an integrated circuit for transferring data to a panel for one frame period. Driving methods of the source driver include a passive driving method and an active driving method. The active driving method is achieved by means of a switching thin film transistor in each pixel of the panel and a storage capacitor for storing data. The active driving methods include a voltage driven method and a current driven method. The voltage driven method has a voltage form as a final output, and the current driven method has a current form as a final output. The methods are determined according to the type of a liquid crystal.

FIG. 1 is a block diagram of a conventional source driver for a voltage driven active matrix organic electroluminescent device. The conventional source driver includes a shift register 110, a data latch 120, a line latch 130, a level shifter and voltage type digital-to-analog converter (DAC) 160, and an analog output buffer circuit 170.

The shift register 110 generates an enable signal for sequentially storing RGB data in the line latch 130 and outputs the enable signal to the line latch 130. The shift register 110 operates in synchronization with rising edges or falling edges of a clock signal CLK and a shift direction is determined by a shift direction control signal L/R. Start pulse input/output signals IO1 and IO2 can be input signals or output signals according to the shift direction control signal L/R. The start pulse input/output signals IO1 and IO2 can be inputted from an external neighboring source driver. Also, the start pulse input/output signals IO1 and IO2 can be inputs of a neighboring source driver chip.

The data latch 120 is a latch for storing the RGB data inputted to the source driver chip from an outside of the chip.

The line latch 130 sequentially stores data for one line period in response to the enable signal outputted from the shift register 110 and transfers the stored data to the level shifter and voltage type DAC 160 in parallel at one time in response to the load signal LOAD. At the same time, a new RGB data is stored in the line latch 130. The load signal LOAD is a clock signal of the line latch 130.

The level shifter 160 shifts the voltage level from a normal voltage to a high voltage. The level shifter 160 is required because the shift register 110, the data latch 120 and the line latch 130 are the blocks that perform a high speed operation at a normal voltage, and the voltage type DAC 160 and the analog output buffer circuit 170 are the blocks that perform a low speed operation at a high voltage in order for a high voltage driving. The level shifter 110 also performs a high voltage operation. Here, the normal voltage represents a voltage VDD and the high voltage represents an output voltage HVCC for driving the source line of the panel. FIG. 2 shows a relative difference between the normal voltage VDD and the high voltage HVCC.

Since an analog signal is required for gray scale, the voltage type DAC 160 receives a digital signal from the line latch 130 and converts it into an analog signal. Generally, the voltage type DAC 160 converts a digital data into an analog data through a resistor string (R-string). At this time, a characteristic of the panel can be compensated using gamma reference voltages at the outside of the panel.

The output buffer circuit 170 outputs the analog voltage as a final output to the source lines of the panel. Here, the source lines are data lines extended in a column direction and source terminals of the switching TFTs constituting the pixels of the panel are connected to the source lines.

As described above, the conventional source driver for the voltage driven active matrix organic electroluminescent device is divided into the normal voltage operating circuit blocks and the high voltage operating circuit blocks. The high voltage operating circuit blocks 160 and 170 occupy most area of the source driver chip and have a large power consumption because the power consumption is proportional to the square of the voltage. Accordingly, it is difficult to achieve a large scale integration since the integration of chip is determined by the high voltage operating blocks. Additionally, the conventional source driver is provided with a structure having a very large power consumption.

SUMMARY OF THE INVENTION

It is, therefore, an object of the present invention to provide a source driver for a current driven active matrix organic electroluminescent device, in which a low power and high integration can be achieved by operating all internal elements at a normal voltage and internal circuits can be shield from a high voltage of a panel.

It is another object of the present invention to provide a current driven active matrix organic electroluminescent device including the source driver.

In accordance with one aspect of the present invention, there is provided a source driver for a current driven active matrix organic electroluminescent device, which comprises: a shift register for generating an enable signal for storing data; a data latch circuit for storing digital data inputted from an exterior; a line latch circuit for sequentially storing the data in response to the enable signal and outputting the stored data in parallel at one time in response to a load signal; a current type digital-to-analog converter for converting the digital data outputted from the line latch circuit into an analog signal, the analog signal being outputted in a form of a current signal; and a high voltage shield circuit for transferring the output of the current digital-to-analog converter to source lines of an external panel and for shielding internal circuits from a high voltage of the panel, wherein the shift register, the data latch circuit, the line latch circuit, the current type digital-to-analog converter and the high voltage shield circuit are driven at a normal voltage.

In accordance with another aspect of the present invention, there is provided a current driven active matrix organic electroluminescent device, which comprises: a panel including a plurality of pixels arrayed, wherein each of the pixels includes current-mirror type switching transistors operating at a high voltage and duplicating and outputting currents of the source lines, and an organic ELD for receiving output currents of the current-mirror type switching transistors and emitting a light; and a source driver for current-driving the source lines of the panel and driving all internal circuits at a normal voltage, wherein the source driver includes a high voltage shield circuit for shielding the internal circuits from the high voltage.

The source driver includes a current type digital-to-analog converter for converting a digital data into an analog signal to output the analog signal in a form of a current signal, and the high voltage shield circuit transfers the output of the current type digital-to-analog converter to the source lines of an external panel.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Figure 1:
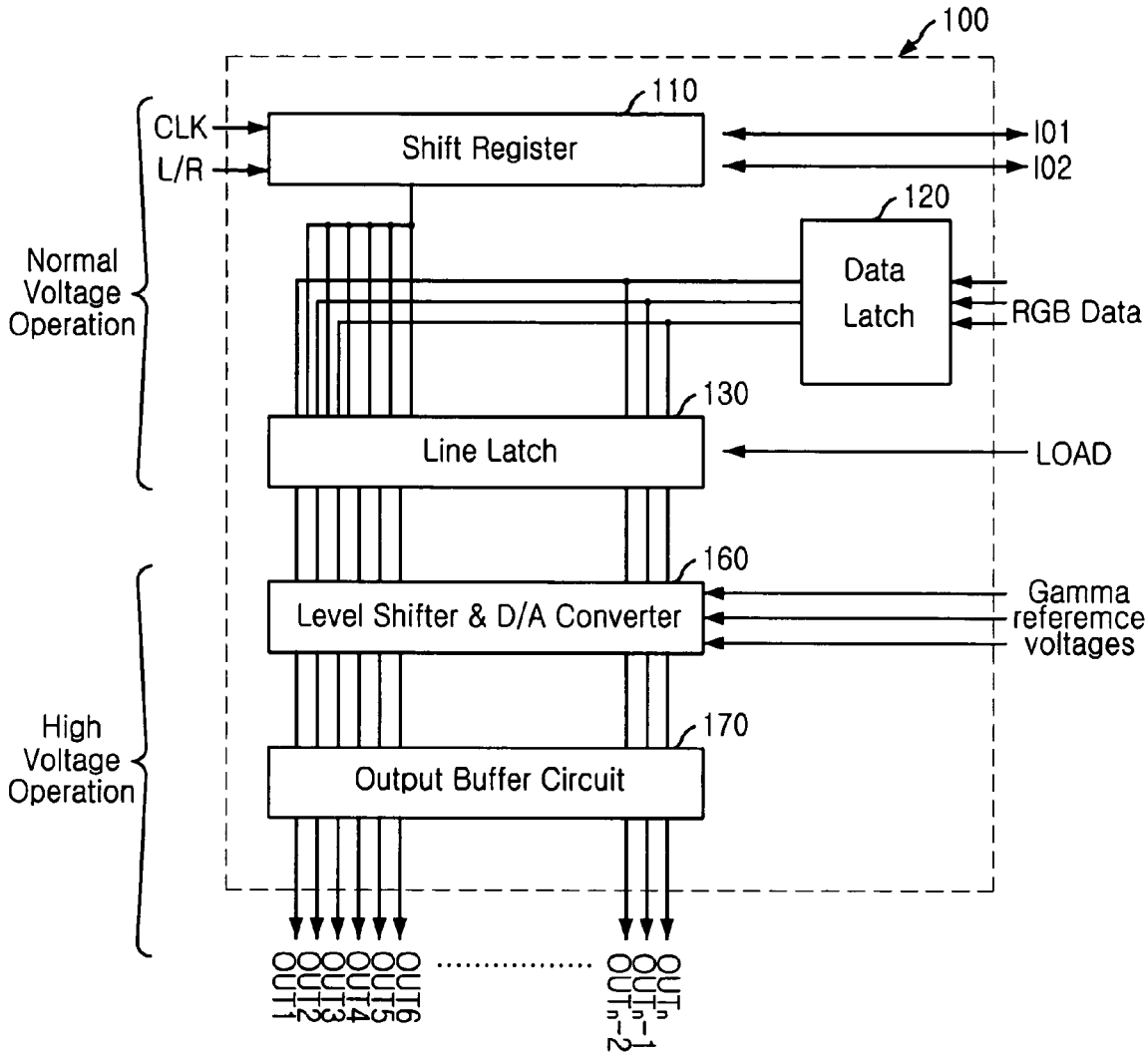
FIG. 1 (PRIOR ART)
FIG. 1 is a block diagram of a conventional source driver for a voltage driven active matrix organic electroluminescent device.
Figure 2:
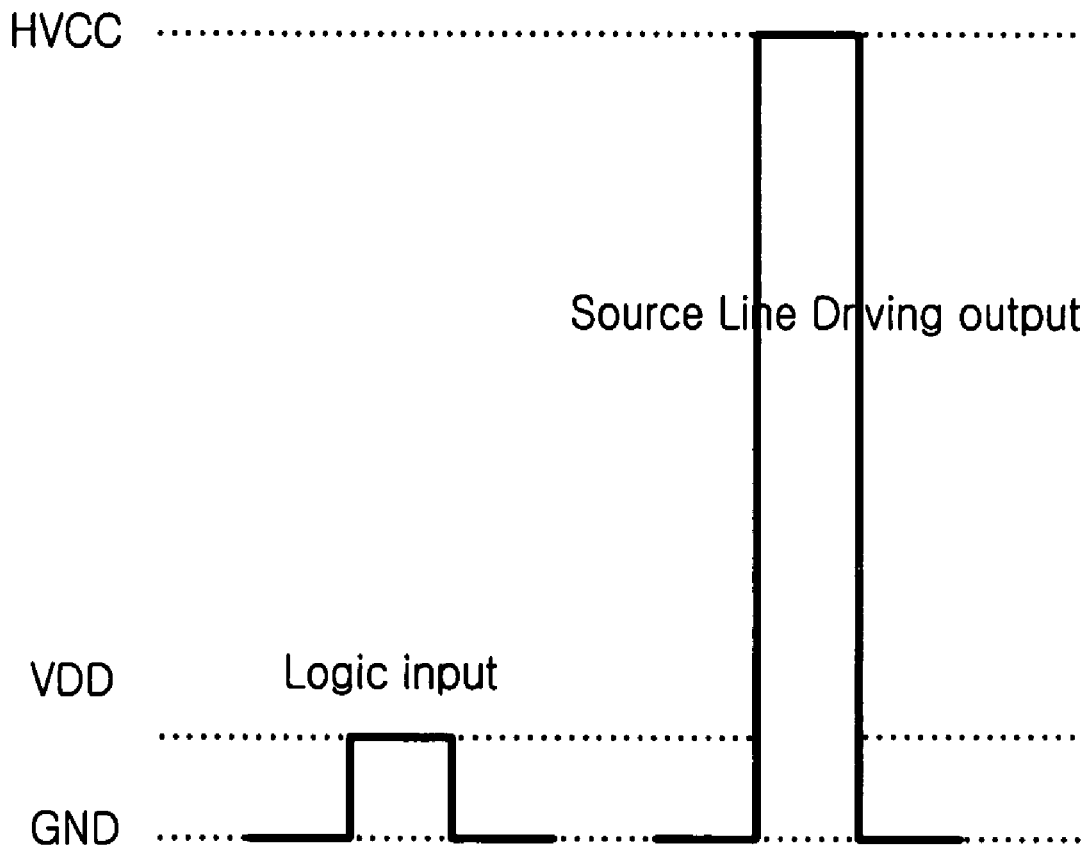
FIG. 2 shows a voltage level that is used in a conventional source driver for a voltage driven active matrix organic electroluminescent device.
Figure 3:
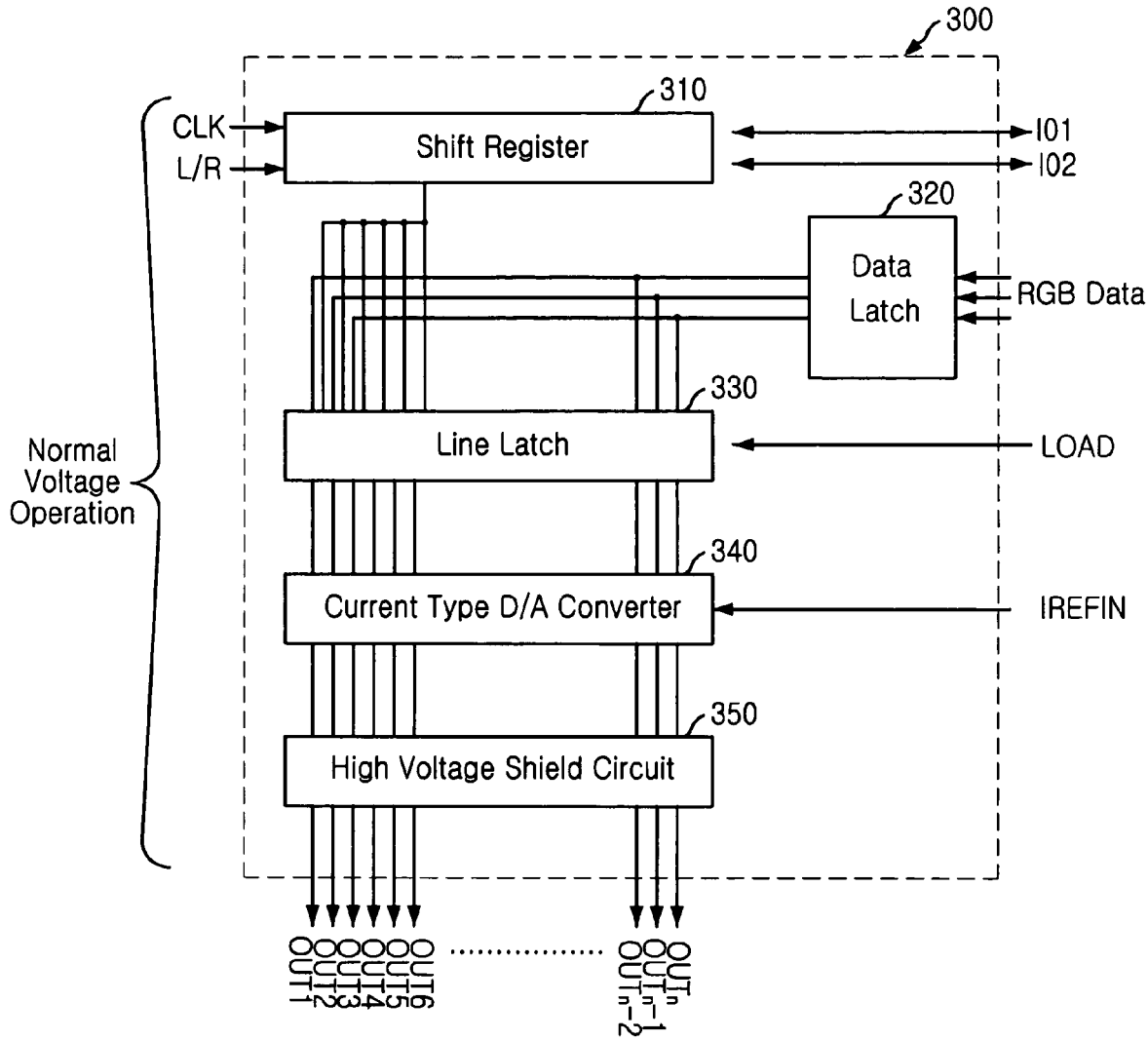
FIG. 3 is a block diagram of a source driver for a current driven active matrix organic electroluminescent device in accordance with the present invention.

FIG. 3 is a block diagram of a source driver for a current driven active matrix organic electroluminescent device in accordance with a preferred embodiment of the present invention.

Referring to FIG. 3, the source driver 300 includes a shift register 310, a data latch 320, a line latch 330, a current type DAC 340, and a high voltage shield circuit 350. The elements 310 to 350 are circuits that operate at a normal voltage VDD.

The shift register 310 generates an enable signal for sequentially storing RGB data into the line latch 330 and the enable signal is inputted to the line latch 330. The shift register 310 operates in synchronization with rising edges or falling edges of a clock signal CLK and a shift direction is determined by a shift direction control signal L/R. Start pulse input/output signals IO1 and IO2 can be input signals or output signals according to the shift direction control signal L/R. Also, the start pulse input/output signals IO1 and IO2 can be input signals of a neighboring source driver chip.

The data latch 320 is a latch for storing the RGB data inputted to the source driver chip from the outside of the chip.

The line latch 330 sequentially stores data for one line period in response to the enable signal outputted from the shift register 310 and transfers the stored data to the current type DAC 340 in parallel at one time in response to the load signal LOAD. At the same time, a new RGB data is stored in the line latch 330. The load signal LOAD is a clock signal of the line latch 330.

The current type DAC 340 receives a reference current signal IREFIN and converts a digital signal transferred from the line latch 330 into an analog signal.

The high voltage shield circuit 350 transfers the output of the current type DAC 340 to external source lines of the panel and shields internal circuits of the chip from the high voltage of the panel. The source lines of the panel are current-driven by respective outputs OUT1, OUT2, . . . , OUTn of the high voltage shield circuit 350.

Figure 4:
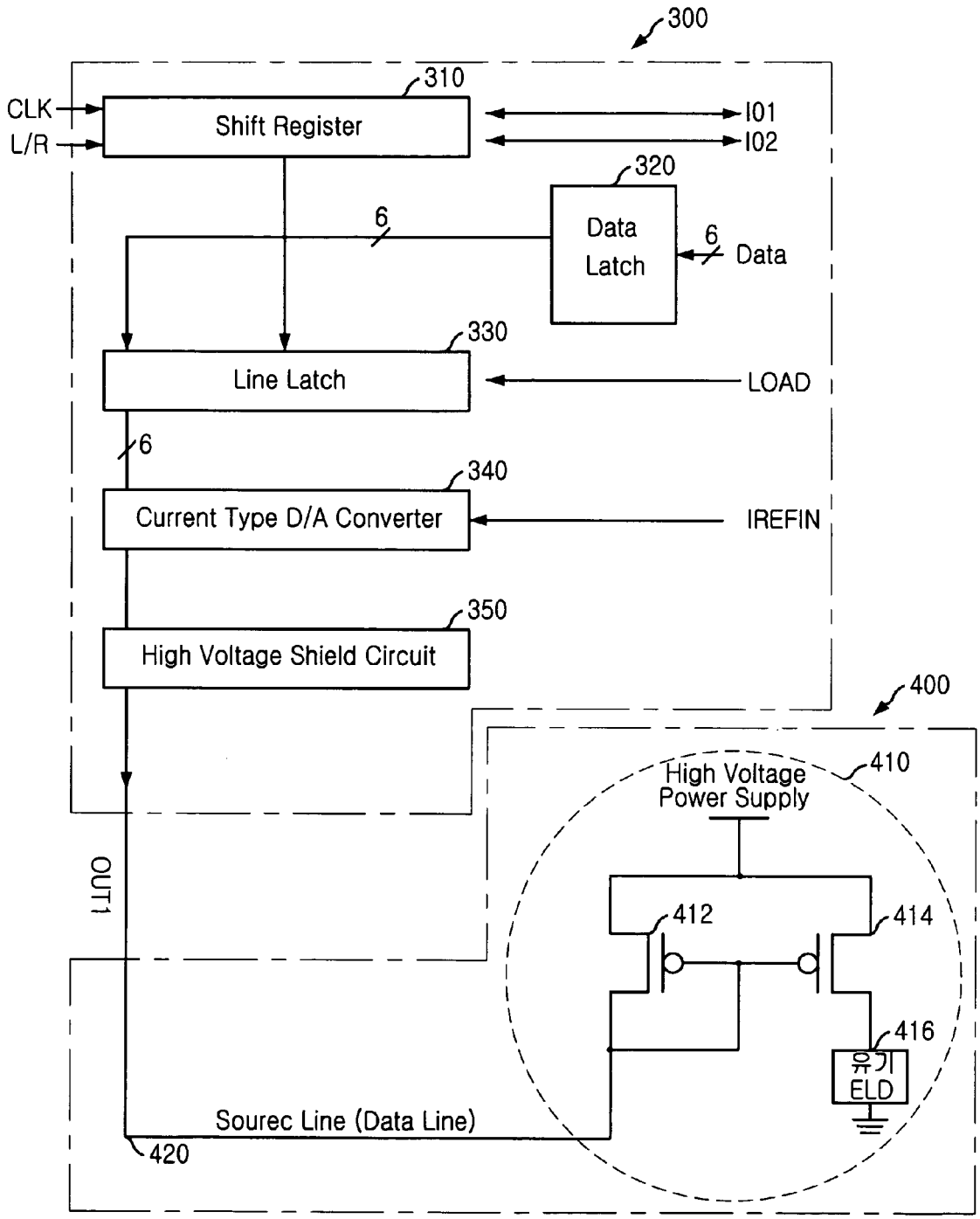
FIG. 4 is a block diagram illustrating one channel of a source driver and a pixel connected thereto, in which one channel corresponds to one output.

FIG. 4 is a block diagram illustrating one channel of a source driver and a pixel connected thereto, in which one channel corresponds to one output. In FIG. 4, the current type DAC 340 receives 6-bit data and outputs an analog signal in a form of a current signal.

Hereinafter, the current driven active matrix organic electroluminescent device in accordance with the present invention will be described in detail with reference to FIG. 4.

The current driven active matrix organic electroluminescent device of the present invention includes a panel 400 and the above-described source driver 300. Here, a plurality of pixels 410 arrayed in the panel 400. Each of the pixels 410 includes current-mirror type switching transistors 412 and 414 and an organic ELD 416. The switching transistors 412 and 414 operate at a high voltage, and duplicates and outputs the current of the source line 420. The organic ELD 416 receives output currents of the switching transistors 412 and 414 and emits a light. The source line 420 is connected to a source terminal of the switching transistor 412 of the pixel. The source line is also called a data line.

The source lines 420 of the panel 400 are current-driven by the source driver 300. Also, the source driver 300 drives all of the internal circuits 310 to 350 at a normal voltage. The source driver 300 includes a high voltage shield circuit 350 for shielding the internal circuits from the high voltage of the panel 400.

Figure 5A:
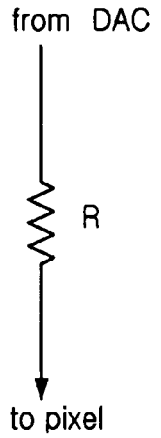
FIG. 5A to 5C are circuit diagrams of a high voltage shield circuit in accordance with embodiments of the present invention.
Figure 5B:
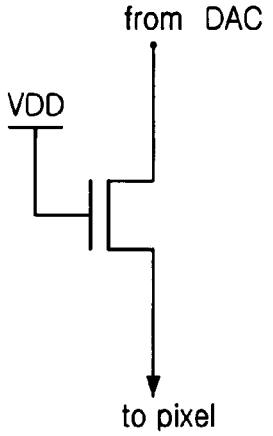
Figure 5C:
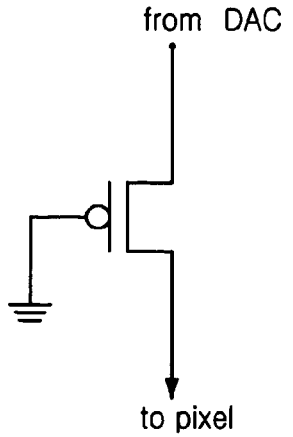

FIG. 5A to 5C are circuit diagrams of the high voltage shield circuit in accordance with embodiments of the present invention.

According to an embodiment of the present invention, as shown in FIG. 5A, the high voltage shield circuit 350 can be provided with a resistor R connected between the output terminal of the current type DAC 340 and the source line 420 of the panel.

According to another embodiment of the present invention, as shown in FIG. 5B, the high voltage shield circuit 350 can be provided with an NMOSFET having a gate receiving the normal voltage VDD and a source-drain path connected between the output terminal of the current type DAC 340 and the source line 420 of the panel.

According to further another embodiment of the present invention, as shown in FIG. 5C, the high voltage shield circuit 350 can be provided with an PMOSFET having a gate receiving a ground voltage GND and a source-drain path connected between the output terminal of the current type DAC 340 and the source line 420 of the panel.

Additionally, although not shown in the drawings, the high voltage shield circuit 350 can be provided with resistive element(s) consisting of other circuits.

Here, if the switching transistors (412 and 414 of FIG. 4) in the pixels of the panel are PMOSFETs, it is preferable to use the high voltage shield NMOSFETs shown in FIG. 5B. Meanwhile, if the switching transistors are NMOSFETs, it is preferable to use the high voltage shield PMOSFETs shown in FIG. 5C.

Figure 6:
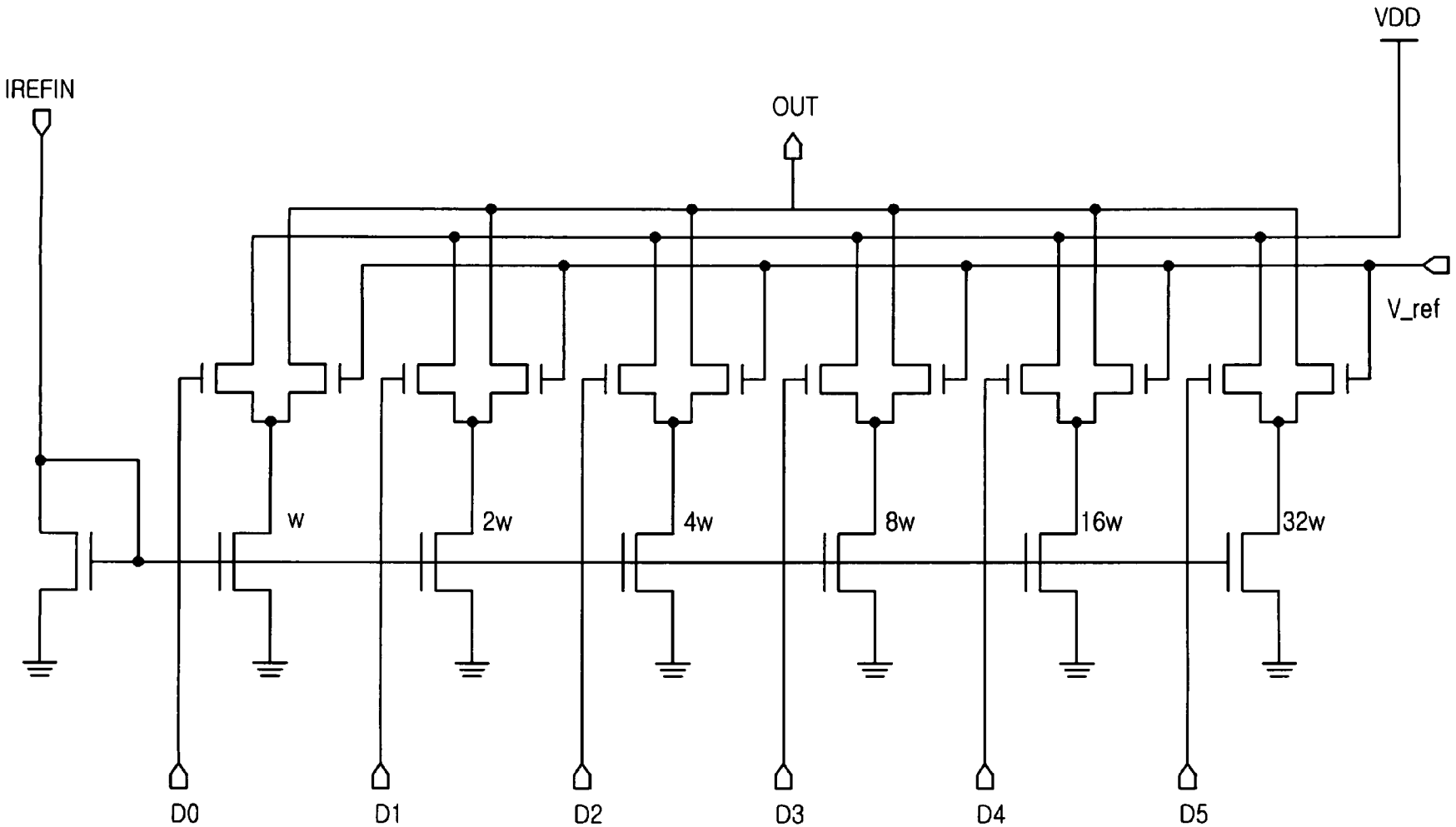
FIG. 6 is a circuit diagram illustrating an example of a current type DAC.

FIG. 6 is a circuit diagram illustrating an example of the well-known current type DAC. In addition to the current type DAC of FIG. 6, various current type DACs are applicable to the source driver of the present invention.

Hereinafter, an operation of the current type DAC will be described. If the digital input data D0-D5 are "111111", all of transistors are turned on, so that the analog output OUT has a maximum value. If the digital input data D0-D5 are "010101", the analog output has a meddle value. Here, reference symbols "IREFIN", "VDD" and "V_ref" represent a reference current, a normal voltage, and a reference voltage, respectively.

According to the present invention, the source driver for the current driven active matrix organic electroluminescent device includes the high voltage shield circuit for shielding the internal circuits from the high voltage of the panel, and the internal circuits operate at the normal voltage. The power consumption of the source driver in accordance with the present invention is low. Further, the source driver has no high voltage circuit blocks that occupy most of the chip area, thereby increasing the integration.

While the present invention has been described with respect to the particular embodiments, it will be apparent to those skilled in the art that various changes and modifications may be made without departing from the scope of the invention as defined in the following claims.

What is claimed is:

1. A source driver for a current driven active matrix organic electroluminescent device, comprising:

a shift register for generating an enable signal for storing data;

a data latch circuit for storing digital data inputted from an exterior;

a line latch circuit for sequentially storing the data in response to the enable signal and outputting the stored data in parallel at one time in response to a load signal;

a current type digital-to-analog converter for converting the digital data outputted from the line latch circuit into an analog data signal, the analog data signal being outputted in a form of a current signal; and a high voltage shield circuit for transferring the analog data signal to source lines of an external panel and for shielding internal circuits of the source driver from a high voltage of the panel, wherein the internal circuits of the source driver are driven at a voltage substantially lower than the high voltage of the panel, the internal circuits of the source driver comprising the shift register, the data latch circuit, the line latch circuit, the current type digital-to-analog converter and the high voltage shield circuit.

2. The source driver as recited in claim 1, wherein the high voltage shield circuit is provided with a resistor connected between an output terminal of the current type digital-to-analog converter and the source lines of the panel.

3. The source driver as recited in claim 1, wherein the high voltage shield circuit is provided with an NMOSFET having a gate receiving the normal voltage and a source-drain path connected between an output terminal of the current type digital-to-analog converter and the source lines of the panel.

4. The source driver as recited in claim 1, wherein the high voltage shield circuit is provided with a PMOSFET having a gate receiving a ground voltage and a source-drain path connected between an output terminal of the current digital-to-analog converter and the source lines of the panel.

5. A current driven active matrix organic electroluminescent device, comprising:

a panel including a plurality of pixels arrayed, wherein each of the pixels includes current-mirror type switching transistors operating at a high voltage and duplicating and outputting currents of the source lines, and an organic ELD for receiving output currents of the current-mirror type switching transistors and emitting a light; and a source driver for current-driving the source lines of the panel, and driving internal circuits of the source driver at a voltage substantially lower than the high voltage of the panel, wherein the source driver includes a high voltage shield circuit for transferring an analog data signal to the source lines of the panel and for shielding the internal circuits from the high voltage, the internal circuits of the source driver comprising a shift register, a data latch circuit, a line latch circuit, a current type digital-to-analog converter and the high voltage shield circuit.

6. The current driven active matrix organic electroluminescent device as recited in claim 5, wherein the source driver includes the current type digital-to-analog converter for converting a digital data into an analog signal to output the analog signal in a form of a current signal, and the high voltage shield circuit transfers the output of the current type digital-to-analog converter to the source lines of an external panel.

7. The current driven active matrix organic electroluminescent device as recited in claim 6, wherein the switching transistor is provided with PMOSFETs; and the high voltage shield circuit is provided with an NMOSFET having a gate receiving the normal voltage and a source-drain path connected between an output terminal of the current type digital-to-analog converter and the source lines of the panel.

8. The current driven active matrix organic electroluminescent device as recited in claim 6, wherein the switching transistor is provided with NMOSFETs; and the high voltage shield circuit is provided with an PMOSFET having a gate receiving a ground voltage and a source-drain path connected between an output terminal of the current digital-to-analog converter and the source lines of the panel.

* * * * *